US005197257A

United States Patent [19]

Nietling

[11] Patent Number: 5,197,257

[45] Date of Patent: Mar. 30, 1993

[54] APPARATUS FOR APPLYING SHINGLES TO A ROOF

[76] Inventor: Roger J. Nietling, 8869 Peet Rd., Chesaning, Mich. 48616

[21] Appl. No.: 890,037

[22] Filed: May 28, 1992

[51] Int. Cl.[5] ..... E04D 15/00

[52] U.S. Cl. ..... 52/749; 182/45; 33/648

[58] Field of Search ..... 52/749, 747, 748; 33/648; 182/45; 227/110, 111, 154

[56] References Cited

U.S. PATENT DOCUMENTS

| | | | |
|---|---|---|---|
| 443,467 | 12/1890 | Templin . | |
| 710,281 | 9/1902 | Leek | 33/648 X |
| 852,141 | 4/1907 | Sebree | 182/45 X |
| 988,808 | 4/1911 | Parris . | |
| 3,292,734 | 12/1966 | Swanberg | 182/45 |
| 3,495,373 | 2/1970 | White . | |
| 3,769,916 | 11/1973 | Hogan . | |
| 3,842,934 | 10/1974 | Bartlett | 182/45 X |
| 4,132,287 | 1/1979 | Parolini | 182/45 |
| 4,785,606 | 11/1988 | Burton . | |
| 4,860,518 | 8/1989 | Kingham | 52/749 X |
| 5,081,815 | 1/1992 | Carnell | 52/749 X |

*Primary Examiner*—Richard E. Chilcot, Jr.
*Assistant Examiner*—Creighton Smith
*Attorney, Agent, or Firm*—Learman & McCulloch

[57] ABSTRACT

An apparatus for applying roofing shingles includes a tracking assembly having a guide track supported by rails removably coupled to the roof and incrementally adjustable upwardly of the roof by increments corresponding to the desired overlap of successive courses of shingles to be laid on the roof. A carriage movably engages the guide track and supports a supply of shingles on edge, which shingles can be laid upon the roof by individually rotating a shingle forwardly causing it to fall from the platform into a positioning cradle of the carriage. A nailing gun is periodically actuated to secure each shingle to the roof as the carriage moves along the track in preparation for installing the next adjacent shingle.

31 Claims, 4 Drawing Sheets

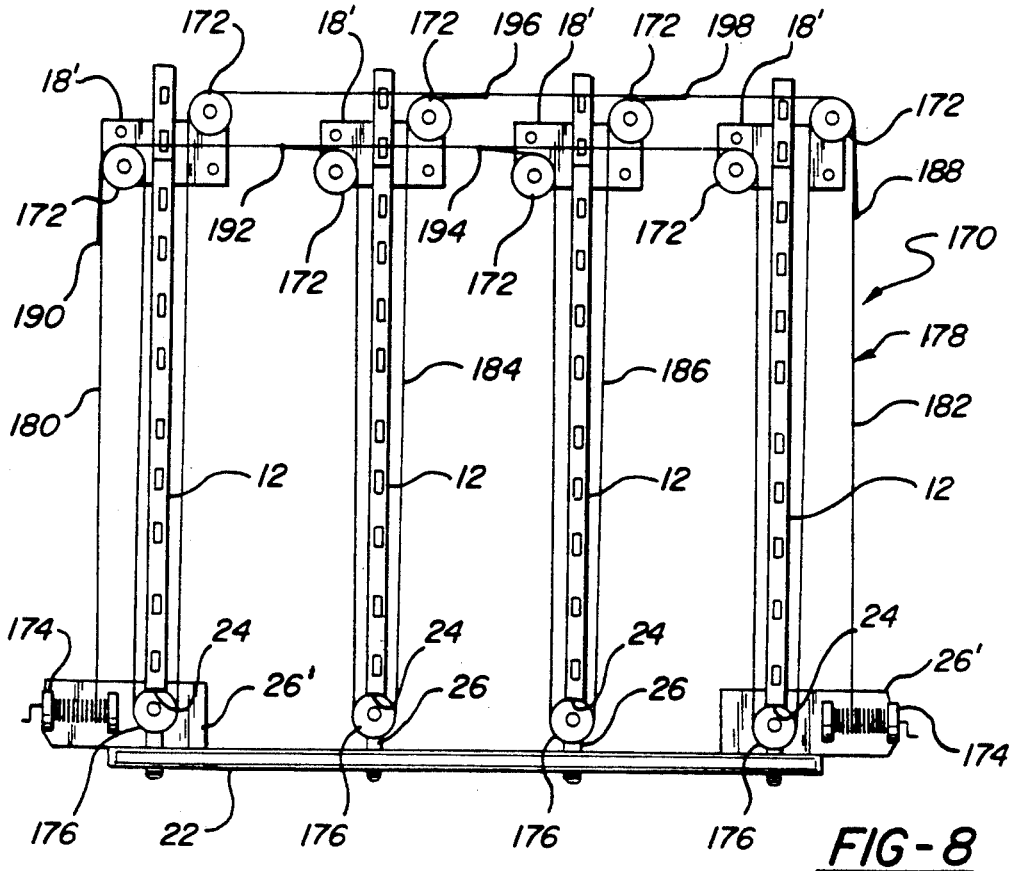
FIG-8
FIG-5
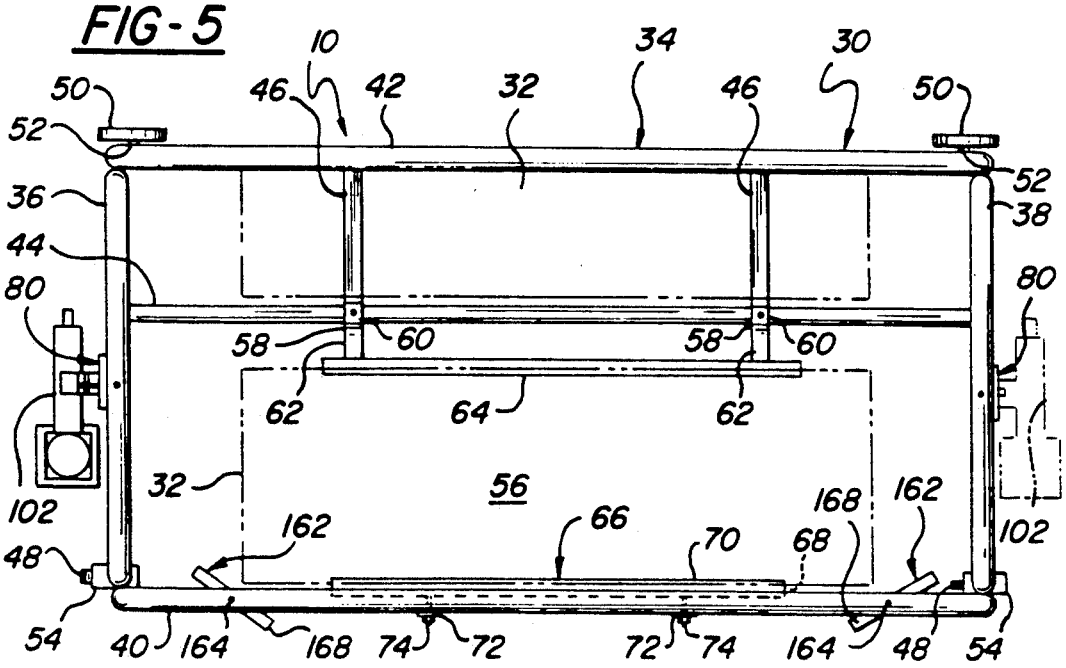

APPARATUS FOR APPLYING SHINGLES TO A ROOF

This invention relates to apparatus for applying shingles to a roof wherein a wheeled carriage supports a supply of shingles and is guided by an adjustable track assembly for individual placement and fastening of shingles to the roof.

BACKGROUND OF THE INVENTION

Overlapping courses of shingles are often applied to the sloped roofs of buildings to protect the roof against the elements. The installation of these shingles typically is a manual process involving several workmen who transport, position and then fasten each shingle to the roof by hand with nails or similar fasteners. A series of chalk line markings often are used as part of this manual procedure in order to align the shingles properly with respect to the edge of the roof and achieve the desired overlap of the successive courses of shingles. For conventional three-in-one residential shingles, this means that a chalk line needs to be provided every five inches or so up the slope of the roof. For these reasons, shingling a roof often constitutes a laborious, tedious, and costly undertaking.

Many machines have been proposed for overcoming the disadvantages of the manual shingling process. Such machines, however, suffer various deficiencies of their own which renders them commercially unviable. For instance, some machines have a motorized carriage to transport and lay the shingles upon the roof. Such machines, however, are costly, heavy and cumbersome making them difficult to handle and operate by one person.

There are other systems employing nonmotorized carriages and complicated, cumbersome tracking systems which guide the carriages along the roof. These systems also are difficult for a single workman to use effectively and are not known to be widely used commercially.

SUMMARY OF INVENTION AND ADVANTAGES

An apparatus for applying shingles to an inclined roof comprises a track defining a substantially horizontal guide path across the surface of the roof; a carriage for supporting a supply of roofing shingles to be applied to the roof and in movable engagement with the track for travel along the guide path; track support means transverse of and coupled to the track for supporting it on the roof; at least one anchor member adapted to be fixed to the roof near the vicinity of its peak and slideably accommodating the support means for enabling the track to be adjusted incrementally in a direction toward the peak; and releasable retaining means for releasably retaining the track in a selected position of adjustment.

The invention also contemplates an adjustable tracking apparatus for supporting and guiding the moveable carriage along the roof. The apparatus comprises a track for defining a substantially horizontal guide path across the surface of the roof, the track being engageable with the carriage for guiding the carriage along the guide path of the track; track support means coupled to the track for supporting the track on the roof; at least one bracket member adapted to be fixed to the roof and slideably accommodating the track support means; and means for moving the track support means and track slideably as a unit with relation to the bracket member for enabling the track to be adjusted incrementally between various positions of adjustment.

On advantage of the invention is that its use enables a single workman quickly and efficiently to apply shingles to a roof. The carriage is light weight and simply constructed as is the adjustable tracking system and easily can be installed and operated by one person.

The tracking system obviates the need for chalk lines as it is incrementally adjustable according to the desired overlap of the courses of shingles. Thus, once set up, the tracking system itself assures that proper alignment and overlap are achieved.

THE DRAWINGS

An embodiment of the invention is disclosed in the accompanying drawings, wherein:

FIG. 5 is a top plan view of the carriage;

FIG. 8 is a top plan view of the tracking apparatus.

DETAILED DESCRIPTION

Figure 1:
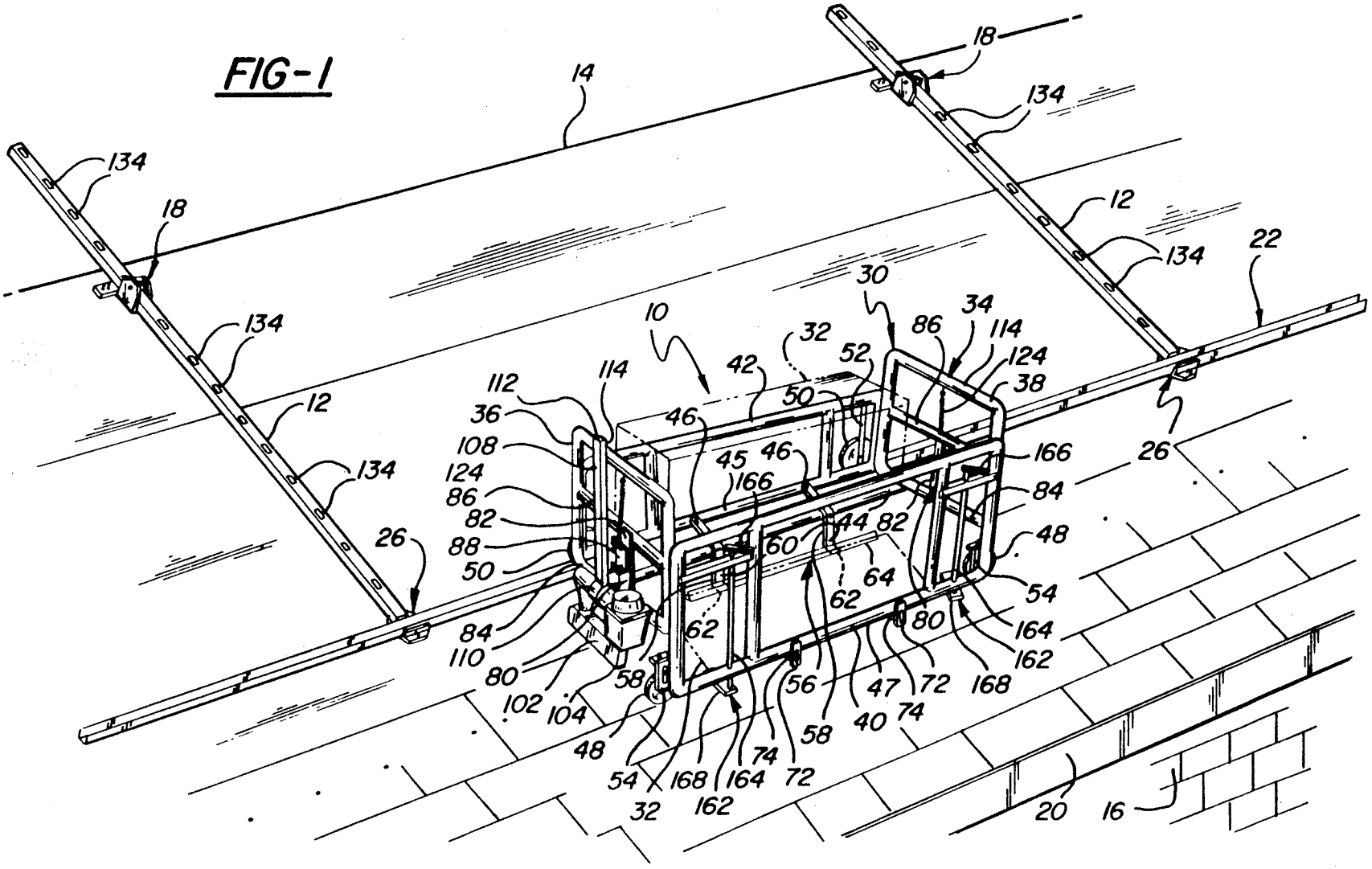
FIG. 1 is a perspective view of the shingling apparatus in condition to apply shingles to a roof.

Shingling apparatus constructed according to a presently preferred embodiment of the invention is designated 10 and comprises an adjustable tracking apparatus having at least two track supporting rails which overlie and extend upwardly along a sloped roof 14 of a building structure 16. Each rail 12 is temporarily secured to the roof so as to extend upwardly from the lower edge 20 of the roof toward the peak. Each rail is accommodated in a bracket 18 for a purpose presently to be described. The rails 12 are preferably spaced fourteen feet apart from one another, but the spacing may vary.

Extending laterally and crosswise to the rails 12 and parallel to the edge 20 of the roof is a guide track 22 which is coupled to each of the rails 12 by a coupling bracket 26. The guide track 22 has a generally U-shaped channel configuration defining a lateral guide path across the sloped surface of the roof 14.

A wheeled shingling carriage 30 is movably engaged with the guide track 22 so as to be movable laterally along the guide path and carries a supply of roofing shingles 32 which are to be applied in overlapping lateral courses on the roof 14. The shingles 32 may be any of a number of commercially known types but preferably are common three-in-one residential type shingles available in packaged bundles containing a stack of the shingles about 3–4 inches thick.

The carriage 30 comprises a generally box-like frame 34 having a pair of spaced apart, parallel, upstanding longitudinal side members 36, 38 interconnected at their opposite ends by front and back cross members 40, 42, respectively. The frame 34 may be constructed of any of a number of different materials but should be constructed so as to be light weight and easily manageable and transportable by a single workman. Materials such as PVC plumber's tubing is a suitable material for the frame 34. The adjacent frame members 36, 38, 40, 42 are rigidly secured to one another by fasteners or other suitable means so as to form a rigid frame construction.

Extending between the side members 36, 38 intermediate and parallel to the front and back members 40, 42 is a lateral cross member 44. The cross member 44 is suitably fixed to the side members 36, 38. One or more longitudinal platform members 46 extend between and connect the lateral member 44 with an extreme lower portion 45 of the back frame member 42 to establish a generally horizontal platform which is perpendicular to the back member 42 and upon which the shingles 32 may be supported on edge in a generally vertical manner with the assistance of the back member 42. The platform 46 may be constructed of any desired width, but it is preferably wide enough and long enough to accommodate at least one bundle of the conventional three-in-one type shingles (i.e., approximately three to six inches wide and about three feet in length).

Figure 7:
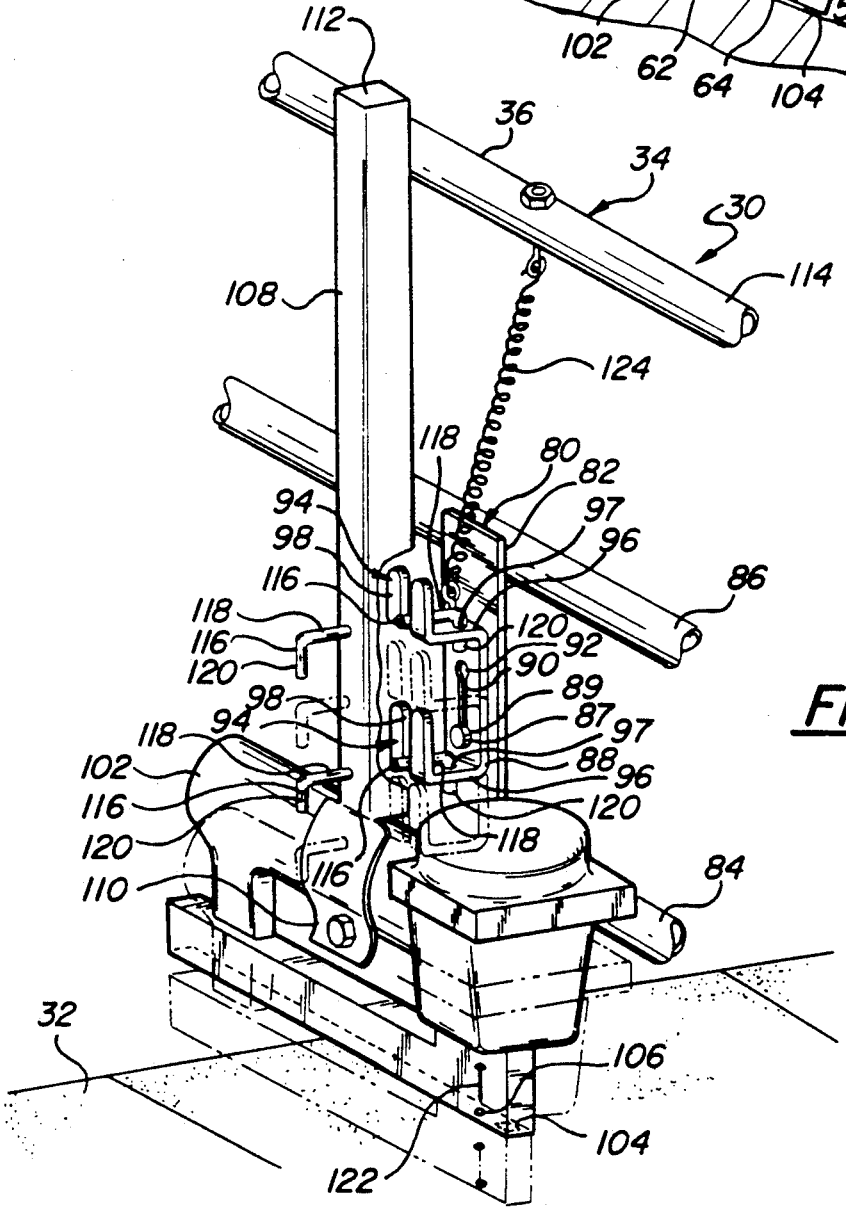
FIG. 7 is a fragmentary perspective view of a mounting assembly for a nailing gun.

As best shown in FIG. 7, the front member 40 is longer from top to bottom than the back member 42, with the extreme lower portion 47 of the front member 40 being lower than that of the lowest edge 45 of the back member 42. The difference in height between the lower edges 45, 47 is chosen to approximate the most common pitch angle of the type roofs to be shingled by the apparatus 10. For example, if the apparatus 10 is to be used mainly to shingle single-story residential structures, then the frame 34 may be constructed with the lower extremities 47, 45 of the front and back members 40, 42 forming a 20° to 30° angle with the horizontal platform 46, so that, when resting upon the slope of the roof with the back frame member 42 above the front member 40, the platform 46 is substantially horizontal.

The frame 34 is provided with a pair of forward wheels 48 and rearward wheels 50. The rearward wheels 50 are journaled on an axle 52 extending from opposite side ends of the back member 42. The axles 52 are perpendicular to the back member 42 and support the wheels 50 for rotation in a generally vertical plane which is parallel to the back member 42. The width of each wheel 50 is such as to enable it to be accommodated within the guide track 22 for maintaining the carriage 30 on a horizontal path.

The forward wheels 48 are mounted on opposite sides of the front member 40 by vertically adjustable brackets 54. The brackets 54 enable the wheels 48 to pivot on the frame 34 and be adjusted vertically relative to the frame 3 to enable the lower portion 47 of the front frame member 40 to be raised or lowered in relation to the surface of the roof 14. This is particularly advantageous when shingling a roof having a greater than conventional pitch since it allows the platform 46 to be adjusted angularly with respect to the slope of the roof 14 to assume the desired horizontal orientation.

In the space between the lateral cross member 44 and the front frame member 40 is a shingle cradle 56 which is adapted to support an individual shingle in position on the roof 14. The shingle cradle 56 comprises a generally L-shaped pair of shingle support arms 58 immediately adjacent the platform 46 with each having an upstanding leg portion 60 coupled to the lateral cross member 44 and extending vertically downwardly therefrom to an inwardly projecting lower leg portion 62. The L-shaped arms 58 preferably comprise flat straps of metal and are formed as one integral piece with the longitudinal platform members 46. Extending transverse to and connecting the lower leg portions is a reinforcing plate 64 which provides lateral stability to the support arms 58.

Opposite the L-shaped support arms 58 is a shingle aligning member 66 carried by the front frame member 40. The member 66 has an upstanding lateral wall or leg 68 which is substantially parallel to and spaced a fixed distance forwardly of the plane of the rearward wheels 50 and is provided to engage the forward edge of a shingle supported in the cradle 56 and align it laterally on the roof 14.

The aligning member 66 comprises an elongate L-shaped metal plate having its upstanding leg 68 coupled to the lower portion 47 of the front frame member 40 and a lower leg portion 70 extending into the cradle space toward the opposite shingle support arms 58. The lower portion 47 of the front frame member 40 has a pair of vertically slotted brackets 72 depending therefrom and slideably accommodating a pair of mounting pins 74 fixed to the backside of the aligning member 66 for enabling the member 66 to be adjusted vertically on the frame 34. Internally threaded nuts 78 are provided on each side of the bracket 72 to retain the member 66 in a position of selected vertical adjustment.

The clearance or space between the lateral cross member 44 and the front frame member 40 is sufficiently wide to enable a shingle supported on edge on the platform 46 to be rotated forwardly to a generally horizontal position and then fall from the platform 46 down into the cradle 56. With most conventional three-in-one shingles, this clearance should be no less than twelve inches.

Mounted on each of the side members 36, 38 of the frame 34 is a support bracket 80 adapted for mounting a shingle fastening device to the frame 34. Each bracket 80 has a vertical base plate 82 secured at its ends to lower and intermediate horizontal cross bars 84, 86 of each side member 36, 38 and spaced from the front and back ends thereof. The base plates 82 have fixed thereto a outwardly projecting pin 8 terminating at its outward end in an enlarged head 89. A slider plate 88 is formed with an elongate vertical slot 90 for accommodating the pin 87 of the base plate 82 and thereby slideably coupling the slider plate 88 to the base plate 82.

The slider plate 88 has at its upper and lower ends identical outwardly and upwardly projecting L-shaped support arms 94. Each arm includes a generally horizontal outwardly projecting portion 96 formed with a hole 97 and upwardly bent at its end to form an upwardly projecting portion comprising a pair of vertical spaced apart fingers defining a generally U-shaped vertical slot 98 therebetween.

As mentioned, the support brackets 80 are adapted for supporting a shingle fastening device, such as a pneumatic nailer or stapler 102, which is thereby carried along with the carriage 30 for periodic actuation to drive staples or nails through the laid-down shingles. The shingle fastening device preferably comprises a known, commercially available pneumatic nailing gun connected to a pressurized air supply (not shown) and operable by impacting a trigger 104 of the gun against the laid-down shingle and thereby causing a nail or staple to be forcibly driven through an opening 106 of the gun 102 spaced approximately six inches rearward of the shingle aligning member 66.

An extension bar 108 is formed at one end with clamping jaws 110 which releasably clamp a handle of the gun 102. The extension bar 108 extends vertically upwardly therefrom to a distal end 112 adjacent an uppermost horizontal cross bar 114 of one or the other side members 36, 38 (depending upon which of the support brackets 80 to which the gun 102 is mounted.) Between the ends of the extension bar 108 are two opposite pairs of outwardly and downwardly extending L-shaped mounting pins 116 which are adapted for removable accommodation in the support arms 94 of the slider plate 88. As shown best in FIG. 7, each mounting pin 116 has a horizontal shank portion 118 for accommodation in the U-shaped slots 98 of the slider plate 88 and a downwardly bent portion 120 for accommodation in the holes 97 of the slider plate 88. Thus, to mount the gun 102 on one of the support brackets 80, the appropriate pair of mounting pins 116 are positioned with their shanks 118 in the vertical slots 98 of the slider plate 88 and with their downwardly bent portions 120 accommodated in the associated holes 97 of the slider plate 88. The opposite pairs of mounting pins 116 enable the same nailing gun 102 to be mounted to the other bracket 80 in the same manner without having to alter the extension bar 108 or its connection to the nailing gun 102.

Since the nailing gun 102 is suspended on the slider plate 88, it is free to move vertically with the slider plate 88 relative to the frame 34. The support bracket 80 thereby enables the nailing gun 102 to be vertically raised or lowered to impact the trigger 104 against the roof 14 and drive a nail 122 through an underlying shingle.

To prevent the trigger 104 from being continuously actuated, each support bracket 80 has a tension spring 124 connected at on of its ends to the slider plate 88 and at its other end to the uppermost horizontal cross bar 114 of each the side members 36, 38 for continuously urging the slider plate 88 and thus the nailing gun 102 to the vertically raised unactuated condition (shown in solid lines in FIG. 7). When it is desired to actuate the nailing gun 102, all that is required is for a workman to push down on the distal end 112 of the extension bar 108 which tensions the spring 124 and forces the slider plate 88 vertically downwardly thereby causing the trigger 104 to engage the underlying shingle and eject a nail or staple from the gun 102 into the shingle, as illustrated by broken lines in FIG. 7. Upon releasing the extension bar 108, the tension spring 124 recoils and returns the nailing gun 102 to the vertically raised position.

Figure 2:
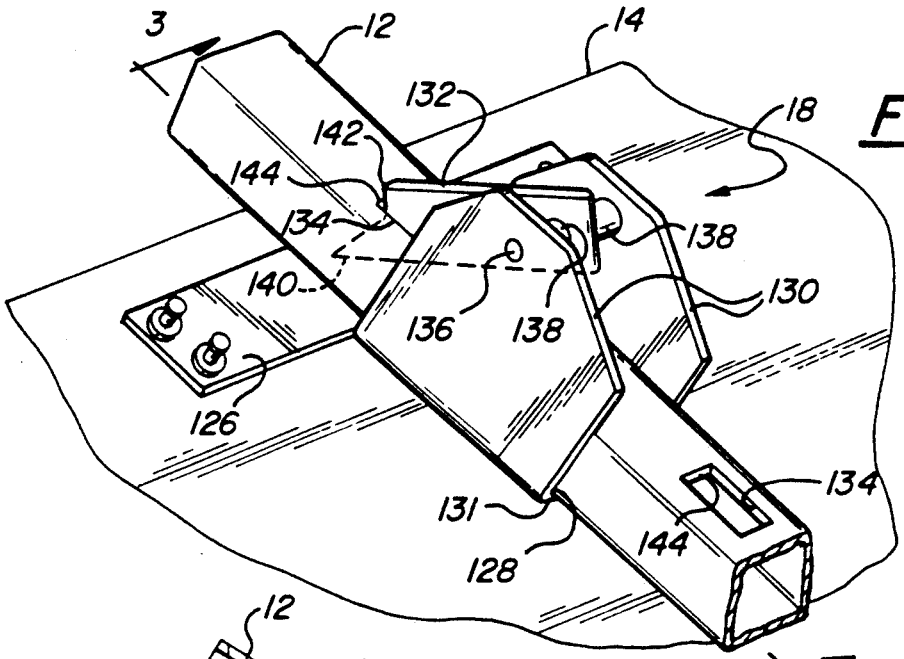
FIG. 2 is an enlarged fragmentary perspective view of an anchor bracket and brace.
Figure 3:
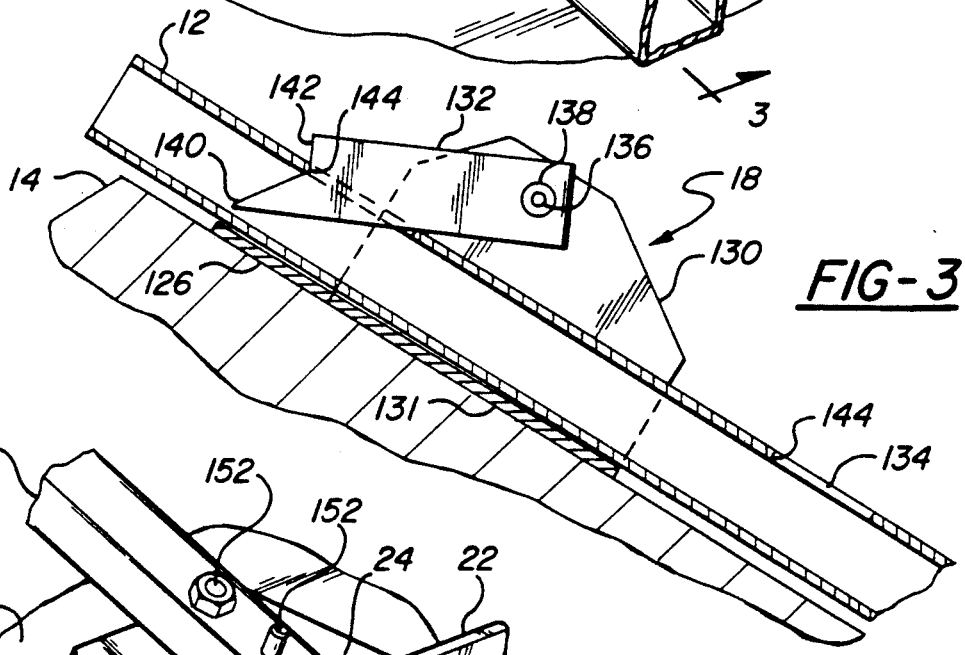
FIG. 3 is a cross-sectional view taken along lines 3—3 of FIG. 2.

FIGS. 2 and 3 illustrate in detail the construction of the rail-accommodating brackets 18 and their interaction with the rails 12. Each bracket 18 is formed with a base plate 126 and a longitudinal channel 128 slideably receiving and supporting one of the tracks 12. Each bracket 12 and guide track 22 therein is adjustable longitudinally of the track 22 as a unit toward the peak of the roof to occupy any selected one of a plurality of adjusted positions. Each base plate 126 is removably fixed to the roof at or near the vicinity of the peak by nails or other suitable fasteners. The base plate 126 is generally T-shaped and planer and is formed with a pair of upwardly bent parallel and spaced apart ears 130 which are interconnected by a lower leg 131 of the base plate 126 to define the channel 128.

Each rail 12 is preferably of square tubular construction with a bottom side thereof supported on the leg 131 of the base plate 126 and opposite sides between the ears 130. The upper ends of the ears 130 extend above the rail 12 and carry a pivoted latch or locking pawl 132 which is designed to cooperate with a plurality of equal spaced catches or slots 134 formed at preselected longitudinally spaced intervals along the top surface of the rail 12, which intervals correspond to the desired amount of overlap of the successive courses of shingles to be applied to the roof. For applying conventional three-in-one shingles, the typical overlap is five inches. Accordingly, the spacing between adjacent catches 134 is five inches.

The locking pawl 132 carries a horizontal pivot pin 136 extending between the ears 130 and has its free end directed toward the roof peak up the incline of the roof and away from the guide track 22. A spacer 138 is provided on each side of the pawl 132 and locates the pawl approximately midway between the ears 130. The free end of the pawl 132 has a triangular extension 140 which can enter any one of the slots 134, as shown in FIG. 3, and an adjacent shoulder 142 designed to engage the upper edge 144 of the slot 134 to lock the rail 12 against downward longitudinal movement, while permitting upward adjustment of the rail 12. The locking pawls 132 and slots 134 thus provide the assembly 10 with means for adjusting the guide track 22 in a direction away from the roof edge 20 at fixed increments corresponding to the proper amount of shingle overlap while maintaining the proper lateral orientation of the guide track 22.

Figure 4:
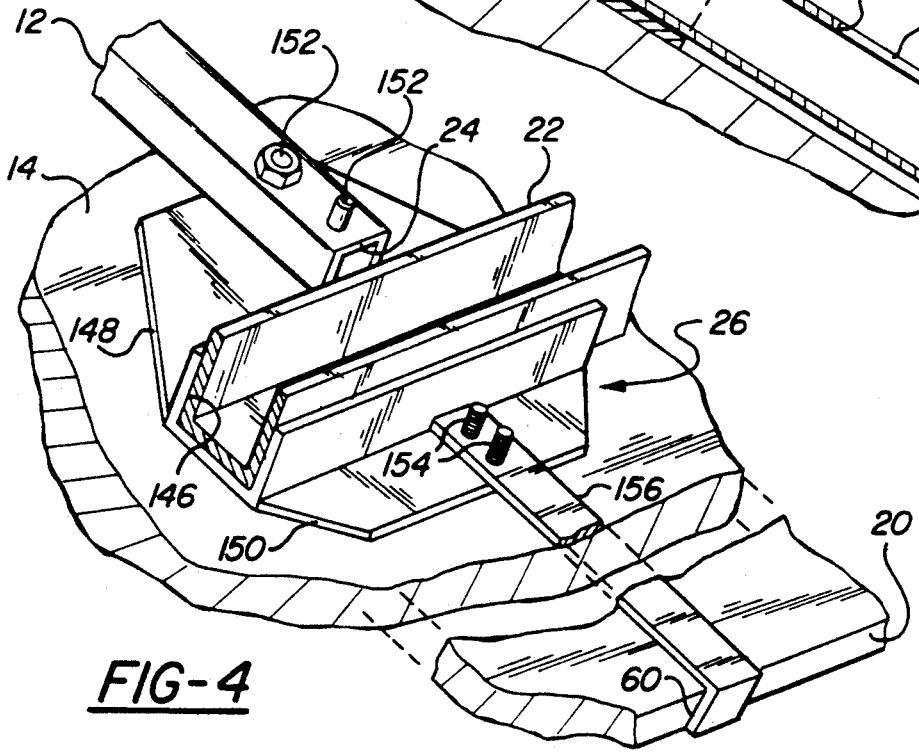
FIG. 4 is an enlarged, fragmentary perspective view, partly in cross-section, of a track coupling bracket.
Figure 6:
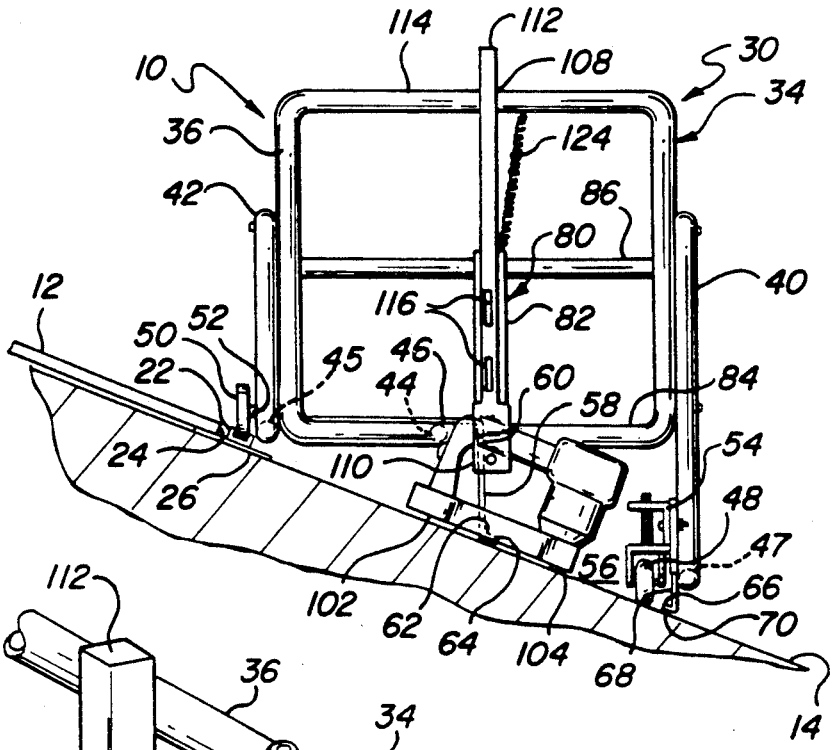
FIG. 6 is an end elevational view of the carriage with a portion of the roof shown in section.

FIG. 4 shows in detail the construction of one of the coupling brackets 26 and the manner in which it connects the guide track 22 to a rail 12. The description will be limited to one only of such coupling brackets 26, it being understood that it is equally applicable to all of the coupling brackets. Each coupling bracket 26 is formed with a generally U-shaped channel 146 and a pair of outwardly extending upper and lower planar flanges 148, 150, respectively. The channel 146 is open at the top for receiving and supporting the U-shaped, elongate guide track 22 therein.

The upper flange 148 has a pair of longitudinally aligned upwardly extending connecting posts 152 which are accommodated in a cooperating pair of mounting holes extending through the rail 12 adjacent the lower end thereof such that the channel 146 is oriented perpendicular to the rail 12 and abuts the lower end thereof. The lower flange 150 similarly is provided with a pair of upwardly projecting, longitudinally aligned posts 154. A gage 156 comprises an elongate strip of metal having at its upper end a pair of horizontally aligned holes for accommodating the posts 154. At its lower end the gage has a downwardly projecting lip 60 spaced a predetermined distance from the channel 146 by an amount equal to the desired overlap of the shingles (e.g., 5 inches). The function of the gage will be described below.

To condition the apparatus 10 for operation, the coupling brackets 126 are secured by the posts 152 to the lower ends of a selected number of rails 12, the number of which will depend on the width of the roof and the desired spacing between rails.

The gauge 156 is mounted on each of the coupling brackets 26 by the posts 154 in the manner previously described and the rails 12 arranged on the roof so that the downwardly bent lip 160 of each gauge 156 overhangs and engages the lateral edge 20 of the roof 14. In this way, the channels 146 of the brackets 26 are parallel to and spaced a uniform preselected distance from the edge 20 of the roof (e.g., 5 inches).

The mounting brackets 18 are slid under the upper free end of each rail 12 and fixed to the roof 14 at or near its peak with the locking pawl 132 of each bracket 18 accommodated in the nearest adjacent slot 134 of the rail 12. In this manner, the rails 12 are free to slide in the brackets 18 in a direction toward the peak of the roof but are locked against downward movement. Once the brackets 26 are mounted and the pawls 132 locked in the slots 134, the gauges 156 are removed from the coupling brackets 26. A suitable length of guide track 22 is then positioned in the channels 146 to establish the lateral guide path for laying the first course of shingles.

The carriage 30 is positioned adjacent one of the side edges of the roof 14 with its rearward wheels 48 disposed in the channel of the guide track 22. The nailing gun 122 is mounted on the trailing side of the carriage 30 adjacent the side edge of the roof and connected to the pressurized air supply (not shown).

The forward wheels 48 are adjusted vertically to orient the platform 46 of the carriage in a horizontal position and the lateral shingle aligning member 66 is adjusted vertically into close proximity to the surface of the roof 14.

A bundle of shingles 32 is loaded onto the platform 46 of the carriage, the shingles being supported on edge with the underside of the shingles facing toward the front frame member 40.

To lay a shingle upon the roof, an operator grasps the top edge of the forwardmost shingle and rotates it forwardly causing it to separate from the remaining supply of shingles and fall from the platform 48 into the cradle 56. Once in the cradle, the front edge of the shingle engages the shingle aligning member 66 and aligns itself laterally with respect to the lateral edge of the roof 20. The lower leg portion 62 of the support arms 58 extend beneath the back side of the shingle whereas the lower leg portion 72 of the aligning member 66 extends beneath the forward edge of the shingle to support it from below. The portion of the shingle intermediate the lower legs 62, 72 is unsupported and rests on the roof.

In order to enable the workman to adjust the shingle in the cradle from side to side on the roof, the carriage 30 is provided with shingle displacers 162. The single displacers 162 comprise a pair of vertical rods 164 journaled in the front frame member 40 on opposite sides of the cradle 56. Each displacer has a handle 166 fixed to the upper end of the rod 164 and a foot 168 fixed to the lower end thereof. To move a shingle sideways in the cradle 56, the workman simply grasps one of the handles 66 and rotates it in the appropriate direction to bring the foot 68 into engagement with one or the other side edges of the shingle and effect sliding lateral displacement of the shingle.

Following placement of the individual shingle, the carriage 30, containing the remaining shingles of the bundle, is rolled along the guide track 22. As the carriage 30 begins to move, the trailing forward wheel 48 runs atop the laid shingle keeping it from moving with the carriage 30 and keeping it in place on the roof 14. During such movement of the carriage 30, the nailer 102 may be operated to secure the laid shingle to the roof.

The next shingle is laid in the same manner and adjusted sideways to abut the previously laid shingle and then is fastened to the roof. This procedure continues until an entire course of shingles has been laid.

To lay successive overlapping courses of shingles, the guide track 22 and rails 12 are slid as a unit upwardly of the roof to retract the locking pawls 132 from their associated slots 134 and locate the pawls in position to be accommodated in the next slots 134. This will adjust, the guide track 22 upwardly a distance of desired shingle overlap. At this time the carriage will be at that side of the roof opposite the stacking side. When beginning to lay the secured course of shingles, the nailing gun 102 is switched to the opposite side of the carriage so that it trails the carriage 30.

By displacing the rails 12 upwardly when adjusting the guide track 22, the rails 12 always are maintained on the unshingled portion of the roof above the carriage 30 and do not interfere with the installation of the shingles.

The entire guide track 22 and rail 12 assembly conveniently may be made of light weight aluminum so as to be manageable by a single workman. The carriage 30 similarly may be made of aluminum or other light weight material such as plastic.

FIG. 8 illustrates a modified tracking apparatus designated generally at 170 similar to the one described previously but provided with a means for moving the rails 12 and track 22 slideably as a unit for positioning the track 22 in any one of the selected positions of adjustment.

The modified tracking apparatus 170 includes the same guide track 22 and rails 12 as described above. The rails 12 are likewise slideably accommodated in mounting brackets 18' which are each provided with a pair of upper pulleys 172 mounted to the bracket 18' on opposite sides of the associated rail 12. Like the previously described tracking apparatus, the modified apparatus 170 may be provided with a number of such rails 12 and brackets 18', depending upon the width of the roof 14. FIG. 8 illustrates four such rails and brackets and arranged so as to define a left and right end pair of brackets 18' and rails 12 and two intermediate brackets 18' and rails 12 therebetween. Each of the brackets 18' are provided with the upper pair of pulleys 172 fixedly mounted to the bracket 18' on either side of the rails 12.

The free ends 24 of the intermediate rails 12 are provided with coupling brackets 26 of the type previously described for supporting the guide track 22. The free ends 24 of the left and right end rails 12 are provided with a modified coupling bracket 26' which, in addition to supportively accommodating the guide track 22, has fixedly mounted thereto a respective left and right cable length adjust controller 174, whose function will be described below.

Fixedly mounted to each of the coupling brackets 26, 26' is a lower rotatable pulley 176.

Extending between the left and right controllers 174 and around the pulleys 172, 176 is flexible cable means 178 for controlling the movement of the track 22 and rails 12 relative to the brackets 18'. The cable means 178 may be routed around the pulleys with a number of different configurations but is shown in FIG. 8 to comprise a left and right main cable 180, 182 coupled with a pair of left and right intermediate cables 184, 186. This cable arrangement allows for adjustment in the track and rail assembly by operation of either the left or right controller 174 and assures that each rail 12 is adjusted uniformly. The left main cable 180 is shown as having one end joined to a spool of the left hand controller 174. From there, the left main cable 180 extends upwardly to engage one of the upper pulleys 172 of the left-most bracket 18 and then across to engage a corresponding one of the upper pulleys 172 of the intermediate and right hand-most bracket 18', and thence downwardly around the lower pulley 176 of the right hand-most bracket 26' and upwardly to engage the other upper pulley 172 of the right hand-most bracket 18'. The left main cable 180 is fixed to the right main cable 182 at location 188 by any suitable means, such as a weld or separable coupling.

The right main cable 182 is connected at one end to a spool of the right hand controller 174 and extends upwardly therefrom to engage one of the upper pulleys 172 of the right hand-most bracket 18', across to engage the other of the upper pulleys 172 of the intermediate and left-most brackets 18' not engaged by the left main cable 180, and thence downwardly around the lower pulley 176 of the left hand coupling bracket 26' and upwardly to engage the other upper pulley 172 of the left hand bracket 18'. The free end of the right main cable 182 is coupled to the left main cable 180 at 190 in a similar manner as described with reference to connection 188.

The intermediate cables 184, 186 are connected at one of their ends to the left main cable 180 at locations 192 and 194 and at the other of their ends to the right main cable at locations 196 and 198, respectively. These couplings 192, 194, 196, 198 may be similar to those described with reference to connection 188.

The left and right controllers 174 may be either operated manually or be motor driven to coil either of the respective left and right main cables 180, 182 on to the rotating spool of the left and right controller to shorten the effective length of the left and right main cables 180, 182 and effectuate an adjustment of the track 22 upwardly toward the brackets 18'.

The disclosed embodiments are representative of a presently preferred form of the invention, but are intended to be illustrative rather than definitive thereof. The invention is defined in the claims.

What I claim is:

1. Apparatus for applying shingles to a roof comprising track means for defining a substantially horizontal guide path across the surface of the roof; carriage means for supporting a supply of roofing shingles to be applied to the roof and engageable with said track means for movement along said guide path; track support means coupled to said track means for supporting said track means on the roof; adjusting means having at least one bracket member adapted to be fixed to the roof near the vicinity of its peak and slideably accommodating said track support means for enabling said track support means and said track means to move as a unit relative to said bracket member for positioning said track means in any selected one of a plurality of adjusted positions; and releasable retaining means for releasably retaining said track means in said selected position of longitudinal adjustment.

2. Apparatus according to claim 1 wherein said releasable retaining means provides selected increments of adjustment of said track means.

3. Apparatus according to claim 1 wherein said releasable retaining means permits one way only adjustment of said support means.

4. Apparatus according to claim 1 wherein said releasable retaining means comprises a latch carried by said bracket member and selectively coacting with any selected one of a plurality of incrementally spaced catches along the length of said track support means.

5. Apparatus according to claim 4 wherein said catches are spaced about five inches apart.

6. Apparatus according to claim 4 wherein each of said catches comprises a plurality of evenly spaced slots formed in said track support means.

7. Apparatus according to claim 4 wherein said latch comprises a pawl pivotally mounted on said bracket member for separable engagement with said catches to enable adjustment of said track support means in one direction and locking said support means movement in the reverse direction.

8. Apparatus according to claim 1 including coupling means fixed to a free end of said support means and joining said track means crosswise to said track support means.

9. Apparatus according to claim 8 wherein said coupling means is separable for enabling separation of said track means and said track support means.

10. Apparatus according to claim 8 wherein said coupling means includes a channel in which said track means is removably accommodated.

11. Apparatus according to claim 8 including gage means extending from said coupling means a predetermined distance for engaging a lateral lower edge of the roof and spacing said track means from the roof edge.

12. Apparatus according to claim 1 including wheels mounted on said carriage means for engaging said track means.

13. Apparatus according to claim 12 wherein said wheels comprises a first set of wheels engageable with said track means and a second set of wheels spaced from said first set, one of said sets being vertically adjustable relative to said carriage means.

14. Apparatus according to claim 1 wherein said carriage means includes a platform for supporting a bundle of shingles on edge.

15. Apparatus according to claim 1 wherein said carriage means includes lateral shingle alignment means for engaging a lower edge of the shingles and aligning them laterally on the roof.

16. Apparatus according to claim 15 wherein said shingle alignment means is adjustable vertically relative to said frame.

17. Apparatus according to claim 15 including sideways shingle displacement means carried by said carriage means for engaging a side edge of an individual shingle and displacing it sideways on the roof.

18. Apparatus according to claim 15 wherein said lateral shingle alignment means includes an elongate L-shaped member.

19. Apparatus according to claim 1 including shingle securing means carried by said carriage means for securing the shingles to the roof.

20. Apparatus according to claim 19 wherein said securing means is movable vertically on said carriage means for actuation thereof.

21. Apparatus according to claim 20 including biasing means for constantly urging said securing means vertically upwardly to a nonactuated position.

22. Apparatus according to claim 19 including separable coupling means for separably coupling said securing means to said carriage means.

23. Apparatus according to claim 1 wherein said adjusting means includes means for moving said track support means relative to said bracket member for adjusting the position of said track means on the roof.

24. An adjustable tracking apparatus for supporting and guiding a movable carriage along a roof, said apparatus comprising:

track means for defining a substantially horizontal guide path across the surface of the roof, said track means being engageable with the movable carriage for guiding the carriage along said guide path;

track support means coupled to said track means for supporting said track means on the roof;

at least one bracket member adapted to be fixed to the roof and slideably accommodating said track support means;

and moving means for moving said track support means and said track means slideably as a unit relative to said bracket member for positioning said track means in any selected one of a plurality of adjusted positions on the roof.

25. Apparatus as set forth in claim 24 wherein said moving means acts between said bracket and said track support means.

26. Apparatus as set forth in claim 24 wherein said moving means has a controller adjacent oppositely spaced ends of said track means for controlling the positioning of said track means at two remote locations.

27. Apparatus as set forth in claim 26 wherein said moving means comprises a cable and pulley mechanism.

28. Apparatus as set forth in claim 24 wherein there are at least a pair of left and right bracket members and said track support means includes at least left and right rail members associated with said left and right brackets respectively, said moving means comprising: a lower pulley fixedly mounted to each of said track support means adjacent a lower end of said left and right rail members; a pair of upper pulleys fixedly mounted to each of said left and right bracket members on opposite respective sides of said left and right rail members; and flexible cable means engaging said pulleys and adjustable in effective length for moving said rail members with relation to said bracket members to effectuate an adjustment in the position of said track means.

29. Apparatus as set forth in claim 28 wherein said moving means includes left and right cable length adjustment means coupled to opposite ends of said cable means for adjusting the effective length of said cable means from either end of said cable means.

30. Apparatus as set forth in claim 28 wherein there is at least one additional intermediate bracket member between said left and right bracket members and an additional intermediate rail member associated with said intermediate bracket member, said moving means comprising an additional intermediate lower pulley fixedly mounted to said support means adjacent the lower end of said intermediate rail member and an additional pair of intermediate upper pulleys mounted to said intermediate bracket member on opposite sides of said intermediate rail member; said cable means also engaging said intermediate pulley for further moving said intermediate rail member with relation to said intermediate bracket member.

31. Apparatus as set forth in claim 24 including means for locking said track support in adjusted position with relation to said bracket.

* * * * *